US009969203B2

(12) United States Patent
Staub et al.

(10) Patent No.: US 9,969,203 B2
(45) Date of Patent: May 15, 2018

(54) PROCESS FOR PRODUCING A MULTILAYER BODY, AND MULTILAYER BODY

(71) Applicants: OVD Kinegram AG, Zug (CH); Leonhard Kurz Stiftung & Co. KG, Furth (DE)

(72) Inventors: René Staub, Hagendorn (CH); Ludwig Brehm, Adelsdorf (DE); Juri Attner, Burgthann (DE); Michael Hoffmann, Walchwil (CH); Peter Seeholzer, Lucerne (CH)

(73) Assignees: LEOHNARD KURZ STIFTUNG & CO. KG, Furth (DE); OVD KINEGRAM AG, Zug (CH)

( * ) Notice: Subject to any disclaimer, the term of this patent is extended or adjusted under 35 U.S.C. 154(b) by 645 days.

(21) Appl. No.: 14/455,521

(22) Filed: Aug. 8, 2014

(65) Prior Publication Data

US 2015/0042084 A1 Feb. 12, 2015

(30) Foreign Application Priority Data

Aug. 9, 2013 (DE) ..... 10 2013 108 666

(51) Int. Cl.

| | |
|---|---|
| ***B42D 25/328*** | (2014.01) |
| ***B42D 25/21*** | (2014.01) |
| ***B42D 25/36*** | (2014.01) |
| ***B42D 25/45*** | (2014.01) |
| ***B42D 25/445*** | (2014.01) |
| ***B42D 25/425*** | (2014.01) |
| *B41M 7/00* | (2006.01) |

(52) U.S. Cl.

CPC ..... *B42D 25/328* (2014.10); *B42D 25/36* (2014.10); *B42D 25/425* (2014.10); *B42D 25/445* (2014.10); *B42D 25/45* (2014.10); *B41M 7/0045* (2013.01)

(58) Field of Classification Search

None

See application file for complete search history.

(56) References Cited

U.S. PATENT DOCUMENTS

| | | | | |
|---|---|---|---|---|
| 2003/0175545 | A1 | 9/2003 | Kastner et al. | |
| 2007/0095224 | A1 | 5/2007 | Brehm et al. | |
| 2007/0206249 | A1* | 9/2007 | Phillips | B42D 25/328 359/2 |
| 2008/0088895 | A1* | 4/2008 | Argoitia | B42D 25/324 359/2 |
| 2009/0317595 | A1 | 12/2009 | Brehm et al. | |

(Continued)

FOREIGN PATENT DOCUMENTS

| | | |
|---|---|---|
| DE | 29622700 | 5/1996 |
| DE | 10333255 | 1/2005 |

(Continued)

*Primary Examiner* — Shamim Ahmed

(74) *Attorney, Agent, or Firm* — Hoffmann & Baron, LLP

(57) ABSTRACT

In a process for producing a multilayer body, an HRI layer made of a material having a high refractive index is applied to at least part of the surface area of a substrate. At least one partial region of the HRI layer is then physically removed from the substrate again by treatment with an alkaline solution. Additionally specified is a multilayer body that can be obtained by such a process.

39 Claims, 8 Drawing Sheets

(56) References Cited

U.S. PATENT DOCUMENTS

| | | | | |
|---|---|---|---|---|
| 2010/0201115 | A1* | 8/2010 | Geuens | B32B 7/12 283/94 |
| 2011/0003166 | A1 | 1/2011 | Brehm et al. | |
| 2012/0064303 | A1 | 3/2012 | Yashiki et al. | |
| 2012/0162771 | A1* | 6/2012 | Walter | G02B 5/1809 359/569 |
| 2015/0070775 | A1* | 3/2015 | Yashiki | G02B 17/006 359/636 |
| 2015/0225570 | A1* | 8/2015 | Konishi | C23F 1/16 106/285 |

FOREIGN PATENT DOCUMENTS

| | | |
|---|---|---|
| DE | 102006037431 | 4/2008 |
| DE | 10143523 | 8/2008 |
| DE | 102008013073 | 9/2009 |
| EP | 2196321 | 6/2010 |
| WO | WO9527925 | 10/1995 |
| WO | WO0231214 | 4/2002 |
| WO | WO2012035546 | 3/2012 |

* cited by examiner

PROCESS FOR PRODUCING A MULTILAYER BODY, AND MULTILAYER BODY

This application claims priority to German Application No. DE 102013108666.7, filed on Aug. 9, 2013.

BACKGROUND OF THE INVENTION

The invention relates to a process for producing a multilayer body having at least one partially shaped layer made of a material having a high refractive index, and to a multilayer body that is obtainable according to the process. The invention additionally relates, in particular, to a security element for security documents and value documents having such a multilayer body.

Optical security elements are frequently used to render more difficult and, insofar as possible, to prevent, the copying and misuse of documents or products. Thus, optical security elements are frequently used to secure documents, banknotes, credit cards, money cards, identity cards, packagings and the like. It is known here to use optically variable elements which cannot be copied using conventional copying methods. It is also known to equip security elements with layers made of materials having a high refractive index (HRI=High Refractive Index) such as, for example, ZnS, in order to create special optical structures. Whereas full surface-area reflection layers made from HRI materials can be produced relatively easily by common application methods such as, for example, sputtering, vapor deposition or the like, the production of structured, partial HRI layers is significantly more complex.

HRI layers can serve as reflection layers because, together with adjacent varnish layers, which usually have refractive indices of medium magnitude, e.g. 1.5, they form an optical boundary layer. This optical boundary layer renders structures at this boundary layer visible, although the structures are embedded between the two layers.

The more production steps that are provided for the production of the security element, the greater the importance that attaches to the register accuracy of the individual process steps, or to the accuracy of positioning of the individual tools, in the formation of the security element, in respect of features or structures already present on the security element.

The term "register accuracy" originates from printing technology. Register marks on are used there, which are applied to various layers or plies. These register marks make it very easy to set the exact relative ply accuracy of the plies or layers in relation to each other, and thereby to achieve a so-called register accuracy. "In register" thus means that the respective plies or layers are aligned with sufficient ply accuracy in relation to each other by means of the register marks. These terms are used in this sense in the following; i.e. it is a matter of aligning layers lying one on top of the other as accurately as possible relative to each other and arranging them "in register".

SUMMARY OF THE INVENTION

It is an object of the present invention to specify a process for producing a multilayer body that can be executed in a manner that is particularly simple and safe in respect of the process. In addition, it is an object of the present invention to specify a multilayer body that can be obtained by means of such a process.

This object is achieved by a process for producing a multilayer body in which a layer made of a material having a high refractive index is applied to at least part of the surface area of a substrate, and at least one partial region of the layer is then physically removed from the substrate again by treatment with an alkaline solution.

In the following, the layer made of the material having a high refractive index is also referred to as an HRI layer (High Refractive Index).

It has been found that such an alkaline solution treatment causes the layer to become detached as a whole in the partial region to be removed. In other words, the layer made of the highly refractive material does not dissolve chemically in the alkaline solution, but physically flakes off from the base. The process is thus not an etching process. In contrast to, for example, the dissolving of zinc sulfide by hydrochloric acid, in this case no toxic by-products such as, for instance in the above example, hydrogen sulfide arise. There are also no residual toxic heavy-metal solutions. The process can therefore be executed particularly safely, does not require any special safety precautions and, in addition, is environmentally benign. Moreover, compared with known physical processes for partially removing layers, such as, for example, laser ablation, the expenditure on equipment is also significantly less, and the process speed that can be achieved is significantly greater.

This object is additionally achieved by a process for producing a multilayer body in which, in at least one first region of a or the substrate, at least one first relief structure is molded into a first surface of the substrate, then a layer or the layer made of a material having a high refractive index is applied to at least part of the surface area of the first surface of the substrate, in such a manner that the layer covers, at least regionally, the at least one first region and at least one second region of the substrate, in which the first relief structure has not been molded into the first surface of the substrate, and then a partial region of the layer is physically removed from the substrate again by treatment with a liquid, in such a manner that the first layer is removed in the partial region covering the at least one second region and remains on the substrate in the partial region covering the at least one first region.

It has been found that the adhesion of the HRI layer to the substrate is significantly greater in the region of relief structures than on smooth surfaces. This can be utilized for removing the HRI layer in regions. For this, conditions are created under which the interfacial adhesion of the HRI layer and the surface in the smooth, second region is just no longer sufficient to hold the HRI layer on the surface, while the greater interfacial adhesion in the first region continues to bind the HRI layer to the surface. This variant of the process can be executed in the case of particularly mild conditions, in particular low alkaline solution concentrations, with the result that it is also suitable for sensitive material combinations. It may also be the case that the use of water suffices as a liquid.

A further advantage of this process variant consists in that the remaining HRI layer remains in register with the relief structures formed into the surface. It is therefore also possible to create highly filigreed structures and patterns, the optical effect of which arises from the interaction of the HRI layer with the relief structure disposed with corresponding positional accuracy.

This object is further achieved by a multilayer body having a substrate, and having a layer made of a material having a high refractive index, wherein, in at least one first region of a or the substrate, at least one first relief structure is molded into a first surface of the substrate, the layer is applied to part of the surface area of the first surface of the substrate, in such a manner that the first layer is removed in the partial region covering the at least one second region and is provided on the substrate in the partial region covering the at least one first region.

Such a multilayer body can be obtained by means of the process explained above, and is characterized by particularly good register accuracy between the first relief structure and the HRI layer.

This object is additionally achieved by a multilayer body having at least one partially shaped layer made of a material having a high refractive index, in register in relation to at least one further partially shaped functional layer. Such a multilayer body can also be obtained by means of the process variant described above, and it is particularly secure against falsification, owing to the maintenance of register between the HRI layer and the partially shaped functional layer.

It is advantageous if the material having a high refractive index is selected from the group zinc sulfide, titanium oxide, niobium pentoxide.

It is additionally advantageous if the alkaline solution is selected from the group sodium hydroxide, potassium hydroxide, sodium bicarbonate, tetramethylammonium hydroxide, sodium ethylenediaminetetra-acetate.

Preferably, a pH value of the alkaline solution is at least 10, since reliable separation of the HRI layer from the substrate can no longer be ensured if pH values are lower. Preferably, the pH value of the alkaline solution is in the range of from 10.5 to 14, more preferably from 11 to 13.

The pH value and specifications relating to conductivity are dependent on temperature. The aforementioned values and all following pH values and specifications relating to conductivity relate to room temperature, of approximately 18° C. to 22° C.

Preferably, the treatment with the alkaline solution is effected at a temperature of from 10° C. to 80° C.

Typically, the reaction speed increases with the concentration of the alkaline solution and the temperature. The choice of process parameters is governed by the reproducibility of the process and the resistance of the multilayer body. Influencing factors in treating with alkaline solution are typically the composition of the alkaline solution bath, in particular the alkaline solution concentration, the temperature of the alkaline solution bath, and the flow conditions of the HRI layer to be treated in the alkaline solution bath.

The treatment with the alkaline solution may furthermore have a time-based temperature profile, in order to optimize the result. Thus, cold treatment can be effected at the start, and warmer treatment effected as the treatment duration increases. In the alkaline solution bath, this is preferably realized by a spatial temperature gradient, wherein the multilayer body is drawn through an elongate alkaline solution bath having differing temperature zones.

Preferably, to aid the separation of the layer, a mechanical treatment of the layer is effected during and/or after the treatment with the alkaline solution.

The physical separation of the HRI layer from the substrate is based on the alkaline solution penetrating into fine pores of the HRI layer, where hydroxo complexes of the HRI material can optionally also form. This causes mechanical stresses to build up in the HRI layer, which ultimately results in the layer flaking off, in the form of fine flakes. An additional mechanical treatment therefore promotes the flaking-off process, and is effected in a controlled manner.

Preferably, the mechanical treatment comprises brushing and/or wiping with a sponge and/or a wiping roller, and/or an ultrasonic treatment, and/or application of a flowing or sprayed liquid to the layer.

In a further preferred embodiment, a mask layer, to protect at least one partial region not to be removed of the layer, is applied to the layer before the treatment with the alkaline solution. The mask layer preferably consists of a material that is not reactive to the alkaline solution. The mask layer thus prevents contact between the alkaline solution and the HRI layer, with the result that, in the partial region covered by the mask layer, the HRI layer cannot separate from the substrate during the alkaline solution treatment. This makes it possible to produce the desired patterns and structures in the HRI layer. Depending on the application process used, structure resolutions of from 0.05 to 0.2 mm can be achieved. This magnitude denotes, for example, the minimum width of a line or of a grid dot that can still be realized cleanly. The structuring of a print roller used to apply the mask layer can be significantly finer. In addition, the mask layer can optionally be printed out more finely. The structure resolution takes account of the entire process up to and including structuring of the HRI layer, wherein significant differences may result, depending on the process control and the materials used, such as, for example, printing varnishes.

Preferably, the mask layer is applied by printing, in particular by gravure printing, flexographic printing, screen printing or inkjet printing of a protective varnish on to the layer. In the case of inkjet printing, in particular, it is possible to provide each individual produced multilayer body with an individual identification, for example a serial number, thereby improving the security against falsification and the authentication capability of the multilayer body.

It is recommended in this case if the protective varnish is a varnish that dries physically or undergoes chemical cross-linking or radiation curing.

In particular, it is also possible to use a protective varnish that comprises pigments and/or dyes and/or pigments that can be UV-activated and/or nanoparticles and/or upconverters and/or thermochromic dyes and/or photochromic dyes. Such a protective varnish may also remain on the multilayer body after the alkaline solution treatment and contribute to the optical appearance of the multilayer body. Since the protective varnish protects the HRI layer against separation during the alkaline solution treatment, the remaining HRI layer is also disposed in exact register in relation to the protective varnish layer.

It is also possible, however, to remove the protective varnish again, at least regionally, after the treatment with the alkaline solution. Precisely a partial removal of the protective varnish can likewise contribute to the overall optical effect of the multilayer body, especially since, here also, the remaining partial regions of the protective varnish are likewise disposed in register in relation to the HRI layer.

It is additionally advantageous if the mask layer is formed by full surface-area application of a positive photoresist, light exposure of the partial region to be removed of the layer, and removal of the light-exposed photoresist. In the case of a positive photoresist, light-exposed partial regions of the photoresist dissolve upon treatment with an appropriate developer, which may also be the alkaline solution. In the partial regions not exposed to light, the photoresist remains on the HRI layer and protects the latter against the action of the alkaline solution during the alkaline solution treatment.

Alternatively, the mask layer may be formed by full surface-area application of a negative photoresist, light exposure of the partial region not to be removed of the layer, and removal of the photoresist not exposed to light. A negative photoresist dissolves in the regions not exposed to light, during the developing of the layer. Here, the photoresist thus remains in the light-exposed partial regions on the HRI layer, where it protects the layer against the action of the alkaline solution. In a further variant, the photoresist may be applied only in partial regions, for example by a printing process, and then structured by light exposure.

It is also possible to use combinations of negative and positive photoresists, in order to create complex patterns. Irrespective of the type of photoresist used, resolutions of down to 0.01 mm can be achieved by light exposure. As already mentioned in connection with printed-on mask layers, it is necessary to distinguish between the resolution that can be achieved in a photoresist by light exposure (which may go down to the sub-micrometer range) and the further, process-related resolution, or minimum feature size, of the structuring of the HRI layer.

It is furthermore advantageous if a photoresist is used that contains dyes and/or pigments and/or pigments that can be UV-activated and/or nanoparticles and/or upconverters and/or thermochromic dyes and/or photochromic dyes. Such a photoresist may remain on the multilayer body, where it likewise contributes to the desired optical effect. As also in the case of use of printed-on protective varnishes, the photoresist is then disposed in register in relation to the remaining HRI layer.

However, the photoresist may also be removed, at least regionally, after the treatment with the alkaline solution. Here, likewise, removal of the photoresist, in particular partial removal, may contribute to the optical appearance.

Preferably, the exposure to light is effected over the full surface area and/or over part of the surface area by means of a laser. In the case of partial surface-area light exposure, it is possible to provide each individual produced multilayer body with an individual identification, for example a serial number, thereby improving the security against falsification and authentication capability, of the multilayer body. This effect may also be achieved by adjustable or modifiable masks.

It is furthermore advantageous if the alkaline solution is printed on to the partial region to be removed of the layer. Since the alkaline solution is printed directly, the HRI layer is attacked only where it comes into contact with the alkaline solution, with the result that, in this way, structured HRI layers can be created particularly easily, without the need for a mask or the like. Such a process can therefore be executed particularly easily and rapidly. After the HRI layer has been separated off in the printed region, the alkaline solution then only has to be rinsed off. Since, in the case of this variant of the process, the alkaline solution only comes into contact with the regions of the HRI layer that are to be separated off, the process can also be applied if the multilayer body has constituents that do not have good resistance to alkaline solution and that could possibly be attacked in an alkaline solution bath.

Preferably, the alkaline solution is printed on by flexographic printing or gravure printing. Depending on the printing method used, structures having a resolution of from 0.1 to 0.2 mm can thus be introduced into the HRI layer.

Preferably, an alkaline solution is used that contains at least one additive to increase the viscosity, and/or at least one wetting agent. This ensures that the printed-on alkaline solution does not flow off, with the result that the desired structure is reliably obtained in the HRI layer. At the same time, the addition of wetting agents ensures good contact between the alkaline solution and the surface of the HRI layer, and an eased penetration of the alkaline solution into the pores of the layer.

In this case, preferably calcium carbonate is used as an additive. Besides calcium carbonate, it is possible to use, for example, kaolin, titanium dioxide, Aerosil or silicon dioxide. The criterion in this case is a material that is largely inert with respect to alkaline solution, and that is obtainable in a fine granular size and can therefore be dispersed sufficiently well in the alkaline solution. Printing of the alkaline solution thus provided with additive can thereby be improved.

It is furthermore advantageous if, before the application of the layer made from the highly refractive material, at least one relief structure is molded in a partial region of the substrate. Such a relief structure makes it possible to achieve further optical effects that, particularly by acting in combination with the reflective HRI layer, contribute to the overall optical impression and the security against falsification of the multilayer body.

As already explained, it has been found that relief structures in the surface of the substrate influence the adhesion of the HRI layer on this surface of the substrate. This can be utilized for removing the HRI layer in regions. For this purpose, conditions are created under which the interfacial adhesion of the HRI layer and the surface in a second region is just no longer sufficient to hold the HRI layer on the surface, while the greater interfacial adhesion in the first region continues to bind the HRI layer to the surface. This variant of the process can be executed in the case of particularly mild conditions, in particular low alkaline solution concentrations, with the result that it is also suitable for sensitive material combinations. It may also be the case that the use of water suffices as a liquid.

A further advantage of this process variant consists in that the remaining HRI layer remains in perfect register with the relief structures formed in the surface. It is therefore also possible to create highly filigreed structures and patterns, the optical effect of which arises from the interaction of the HRI layer with the relief structure. In this case, the structure resolution that can be achieved in the partial HRI layer is approximately 0.015 mm.

The relief structure is typically formed in a so-called replication layer. A replication layer is understood to mean, in general, a layer that can be produced with a superficial relief structure. This includes, for example, organic layers such as plastic or varnish layers, or inorganic layers such as inorganic plastics (e.g. silicones), semiconductor layers, metal layers, etc., but also combinations thereof. Most of these layers have medium refractive indices, around approximately 1.5.

In a replication layer realized as a plastic or varnish layer, in particular made of thermoplastics or a varnish that cures under UV irradiation, a relief structure is stamped-in on the surface, in particular, by means of a tool, in particular a die or a roller. It is also possible to form a surface relief structure by means of injection molding or the use of a photolithography process. Depending on the production process used and the intended subsequent application of the multilayer body formed, transmissive or non-transmissive replication layers may be used, in particular replication layers that are transparent or opaque to the human eye.

It is advantageous, in particular, if the first relief structure is realized with the individual structural elements having a depth-to-width ratio of more than 0.1, in particular more than 0.15, preferably of more than 0.2. Relief structures having such a depth-to-width ratio have proved to be especially effective in increasing the interfacial adhesion of the substrate and HRI layer. This is well substantiated, in particular in the enlarged surface and indentation in the region of the relief structure. The relief structure additionally prevents the propagation of cracks in the HRI layer, which cause the layer to flake off.

Furthermore, it is particularly advantageous if the structure has one of the following relief shapes: rectangular, triangular, stepped, sinusoidal or, also, having irregular, in particular random, elevations and depressions, such as those that occur, for example, in the case of matte structures.

The non-dimensional depth-to-width ratio is a characterizing feature for the enlargement of the surface, preferably of periodic structures, for example having a square sinusoidal course. Here, the depth is designated as the distance between the highest and the lowest consecutive point on such a structure, i.e. it is the distance between "peak" and "valley". The width is designated as the distance between two adjacent highest points, i.e. between two "peaks". The higher the depth-to-width ratio then is, the steeper the "peak flanks" are realized and the thinner the HRI layer deposited on the "peak flanks" is realized. This also results in the HRI layer having a different microcrystalline structure than in the case of deposition on to a smooth surface, which likewise improves the layer adhesion. However, the structures may also be those to which this model is not applicable. For example, they may be discretely distributed, linear regions that are realized only as a "valley", the distance between two "valleys" being greater by a multiple than the depth of the "valleys". In a formal application of the above-mentioned definition, the thus calculated depth-to-width ratio would be approximately zero, and would not reflect the characteristic physical behavior. For this reason, in the case of discretely disposed structures composed substantially only of one "valley", the depth of the "valley" must be in proportion to the width of the "valley".

In a further preferred embodiment, in the at least one second region no relief structure is molded into the substrate, or at least one second relief structure, which differs from the first relief structure, is molded into the substrate. In this way, it is possible to control with precision where the HRI layer is to be retained. Moreover, the use of differing relief structures provides for more complex configuration of the optical appearance of the multilayer body, thereby contributing to the security against falsification.

It is particularly advantageous if the first relief structure and the second relief structure are realized such that, owing to the relief structures, the adhesion of the layer to the substrate is greater in the at least one first region than in the at least one second region, wherein, in particular, the spatial frequency of the first relief structure is greater than the spatial frequency of the second relief structure, the depth-to-width ratio of the structural elements of the first relief structure is greater than the depth-to-width ratio of the structural elements of the second relief structure, and/or the product of spatial frequency and the depth-to-width ratio of the structural elements of the first relief structure is greater than that of the second relief structure. In this way, a greater adhesion of the HRI layer to the substrate is achieved in the region of the first relief structure than in the region of the second relief structure and also, furthermore, a different optical, variable appearance in the first and second region.

It is advantageous, in particular, if the at least one first relief structure and/or second relief structure is realized as, in particular, a one-dimensional or two-dimensional diffractive grating structure, in particular having a spatial frequency of more than 500 lines/mm, preferably of more than 1000 lines/mm.

The diffractive grating structure of the second relief structure is preferably realized with a period of less than 3 μm or with a low aspect ratio of <0.1.

Preferably, the at least one first and/or second relief structure is realized as a light-diffracting and/or light-refracting and/or light-scattering and/or light-focussing microstructure or nanostructure, as an isotropic or anisotropic matte structure, as a binary or continuous Fresnel lens, as a micro-prism structure, as a blazed grating, as a macrostructure, or as a combination structure thereof. A multiplicity of optical effects can thereby be realized.

It is furthermore advantageous if, before and/or after the application of the highly refractive layer, at least one further functional layer is applied, in particular partially. A functional layer is understood here to mean one that either exhibits a visually perceptible impression of color or brightness, or the presence of which can be detected electrically, magnetically or chemically. For example, it may be a layer that contains coloring means such as colored pigments or dyes and that is colored, in particular multicolored, in normal daylight. However, it may also be a layer that contains special coloring means, such as photochromic or thermochromic substances, luminescent substances, substances that produce an optically variable effect, such as interference pigments, liquid crystals, metameric pigments, etc., reactive dyes, indicator dyes, which react with other substances accompanied by reversible or irreversible change of color, color-changing pigments, which exhibit differing color emissions upon excitation by means of radiation of differing wavelength, magnetic substances, electrically conductive substances, substances exhibiting a color change in an electric or magnetic field, so-called E-ink® and the like.

Preferably, the at least one further functional layer is realized as a varnish layer or a polymer layer.

The at least one further functional layer may also be realized with the addition of one or more colored, in particular multicolored, functional layer materials. Moreover, it is possible, additionally or alternatively, to realize at least one partially shaped functional layer as a hydrophobic or hydrophilic layer.

It is possible for the at least one further functional layer to be realized as an optically variable layer having an optical effect that differs depending on the viewing angle, and/or as a metallic reflection layer, and/or as a dielectric reflection layer.

It is particularly preferred if the optically variable layer is realized in such a manner that it contains at least one substance having an optical effect that differs depending on the viewing angle, and/or is formed by at least one liquid-crystal layer having an optical effect that differs depending on the viewing angle, and/or by a thin-film layer stack having an interference color effect that is dependent on the viewing angle.

In the case of a further preferred embodiment, after the removal of the partial region of the highly refractive layer, a further layer, made of a material having a high refractive index, is applied. At least one partial region of the layer can then be physically removed from the substrate again by treatment with an alkaline solution, wherein, in particular, one or more of the previously described processes is applied two or more times. In this way, partial regions, of differing layer thicknesses of the HRI layer, are thus created. Since the layer thickness influences the optical properties of the HRI layer, in particular its reflection behavior in respect of differing wavelengths, this can also be utilized to produce various optical effects. Optionally, after the application of the further layer, the removal of the layer in a partial region can be dispensed with, with the result that a full surface-area coating having locally differing layer thicknesses results.

It is advantageous, in particular, if the removed partial region of the highly refractive layer and the removed partial region of the further highly refractive layer do not overlap, or overlap only partially. In the case of partial overlapping of the partial regions, stepped layer thickness gradients may also be produced.

It is advantageous if the at least one, or a partially shaped, functional layer of the multilayer body and/or the at least one partially shaped layer made of a material having a high refractive index is backed with a diffractive relief structure and exhibits a holographic or kinegraphic optically variable effect.

It is additionally advantageous if the at least one, or a partially shaped, functional layer of the multilayer body and the at least one partially shaped HRI layer are mutually complementary, to form a decorative and/or informative geometric, alphanumeric, pictorial, graphical or figural representation. This contributes especially to the security against falsification of the multilayer body, since it is necessary here that the functional layer be disposed in register in relation to the HRI layer. If this is not the case, the desired representation is not realized. In the case of falsification attempts, however, the necessary maintenance of register can be achieved only with difficulty, or not at all.

Preferably, the at least one, or a partially shaped, functional layer of the multilayer body and/or at least the at least one partially shaped HRI layer is realized as at least one line, having a line width in the range of less than 100 μm, in particular in the range of from 5 to 50 μm, and/or as at least one pixel, having a pixel diameter in the range of less than 100 μm, in particular in the range of from 5 to 50 μm.

It is furthermore advantageous if the at least one, or partially shaped, functional layer of the multilayer body comprises one or more of the following layers: a metal layer, in particular an opaque metal layer, a layer containing liquid crystals, a thin-film reflection layer stack having an interference color effect that is dependent on the viewing angle, a colored varnish layer, a dielectric reflection layer, a layer containing fluorescent or radiation-excited pigment or dye. This, likewise, makes appealing optical effects possible, as well as the integration of additional security features into the multilayer body, which features can be perceived, or activated, for example, only in particular spectral ranges.

In the case of a further preferred embodiment, the at least one, or a partially shaped, functional layer of the multilayer body and the HRI layer are realized in complementary colors, at least when viewed at a particular viewing angle or with a particular type of irradiation.

In the case of a further preferred embodiment, the at least one, or a partially shaped, functional layer of the multilayer body and the HRI layer are each realized in linear form, in such a manner that the lines merge into one another without a lateral offset. This, likewise, contributes to the security against falsification since, in this case also, a particularly good maintenance of register must be achieved in producing the multilayer body.

In this case, the lines preferably merge into one another with a continuous color gradient.

In the case of a further preferred embodiment, the at least one, or a partially shaped, functional layer of the multilayer body and/or the layer made of a material having a high refractive index form, at least regionally, a grid image composed of pixels, image spots or lines that are not individually resolvable by the human eye. This can be used for appealing optical effects.

Gridding of the first layer is also possible, in that, besides grid elements that are underlaid with a reflection layer and that have—possibly differing—diffractive structures, besides grid elements are provided that represent transparent regions without a reflection layer. An amplitude-modulated or area-modulated gridding may be selected as a gridding. Through a combination of such reflective/diffractive regions and non-reflective, transparent—possibly also diffractive—regions, it is possible to achieve interesting optical effects. If such a grid image is disposed, for example, in a window of a value document, a transparent grid image can be seen in transmitted light. In reflected light, this grid image is visible only in a particular angular range, in which no light is diffracted/reflected by the reflecting surface areas. Further, it is also possible not only to use such elements in a transparent window, but also to apply them to a colored imprint. Furthermore, it is also possible, through appropriately selected gridding, to realize a plurality of tapering-off reflection regions that diminish in their reflection effect.

Preferably, the multilayer body has at least one further partially shaped layer made of a highly refractive material.

In the case of a further preferred embodiment, a first transparent spacer layer is realized between the at least one, or a partially shaped, functional layer of the multilayer body and the, or the further partially shaped, layer.

It is further preferred if the at least one, or a partially shaped, functional layer of the multilayer body and the HRI layer are realized in such a manner that at least one optical overlay effect, possibly dependent on the viewing angle, is exhibited.

Preferably, the multilayer body is realized as a foil element, in particular as a transfer foil, a hot-stamping foil or a laminating foil. This may also be a security thread to be inserted in or applied to a security paper or a card. The foil element in this case preferably has an adhesive layer on at least one side.

It is also possible, however, for the multilayer body not only to be a foil element, but also to be a rigid body.

Further, the multilayer body preferably constitutes a decorative element or security element, in particular for protecting security documents such as, for example, banknotes or ID documents. Advantageously, rigid bodies, such as an identity card, a base plate for a sensor element, semiconductor chips or surfaces of electronic devices, for example a casing shell for a mobile telephone, may also be provided with a multilayer body of the type described.

BRIEF DESCRIPTION OF THE DRAWINGS

The invention is exemplarily explained exemplarily on the basis of the drawings. There are shown in FIG. 1 schematic sectional representations of three differing primary products for the production of a multilayer body;

FIG. 2 shows a multilayer body 100. The multilayer body 100 comprises a carrier foil 1. A first functional layer 2 and a second functional layer 3 have been applied to the latter. The functional layers 2, 3 may be, for example, separation layers and/or protective layers. Disposed on the functional layer 3 there is a replication layer 4. The latter has a first relief structure 5 and a second relief structure 6 on its surface. A layer 7, made of a highly refractive material (HRI layer) 7, has been applied in register with the first relief structure 5 and in partial register with the relief structure 6. The replication layer 4 and the HRI layer 7 are covered by a transparent protective varnish 8.

Figure 1:
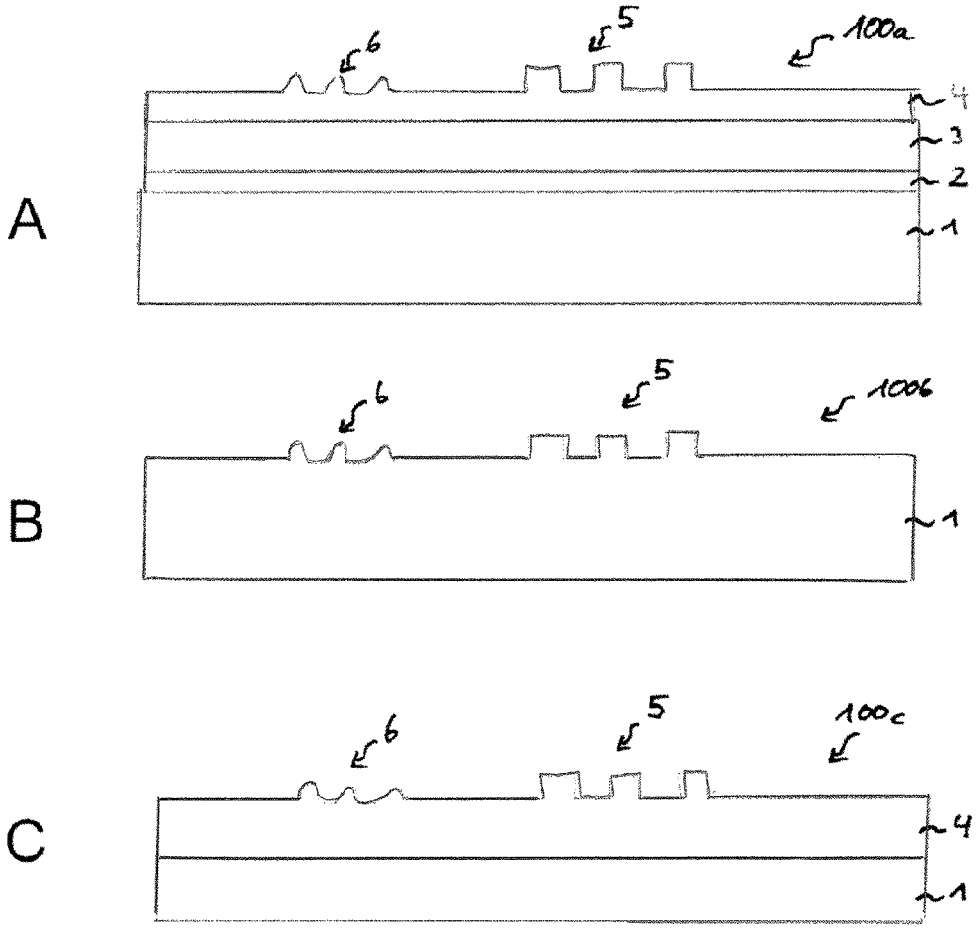
Figure 2:
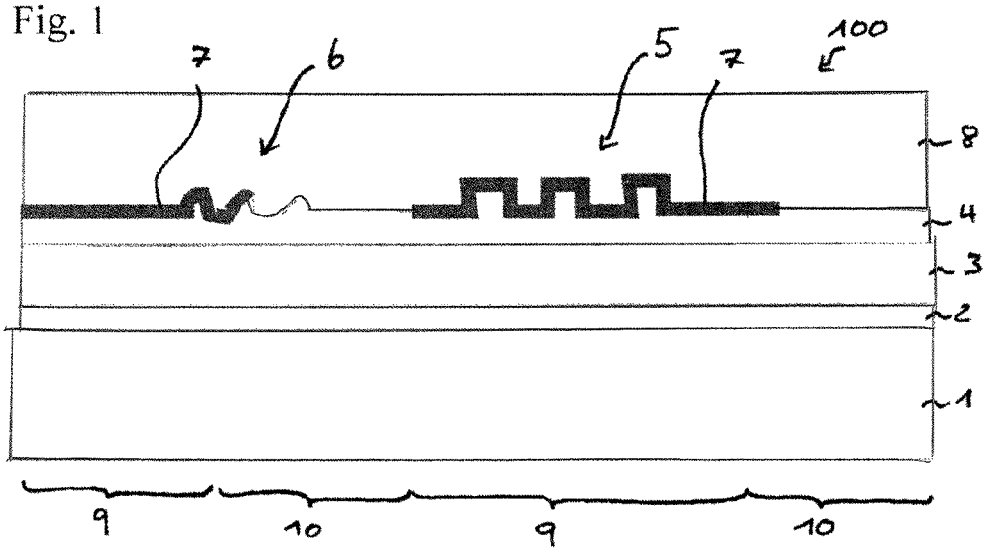
FIG. 2 a schematic sectional representation of an embodiment example of a multilayer body.

Such multilayer bodies 100 can be produced in a variety of ways. The primary products 100*a*, 100*b*, 100*c* shown in FIG. 1 may be used as starting product. The primary product 100*a* has the carrier foil 1, which may consist, for example, of PET or PEN, functional layers 2 and 3, and the replication layer 4. The functional layers 2 and 3 determine the separation behavior of the transfer layer from the carrier foil 1, the resistance against environmental influences, and optical properties of the multilayer body 100. The functional layers 2, 3 may also be selected such that the carrier foil 1 remains on the finished multilayer body 100, with the result that a lamination foil is obtained.

DETAILED DESCRIPTION OF THE INVENTION

The primary product 100*b* is a variant, in which the carrier foil 1 itself serves to receive the relief structures 5, 6. This may be, for example, a foil made of PET, BoPP, PVC or PC.

The primary product 100*c* shows a carrier foil 1 that has been co-extruded together with a second layer 4 serving as a replication layer, or that has been laminated with a second foil 4 serving as a replication layer.

In all variants, the thickness of the carrier film is 6 μm to 250 μm, preferably 10 μm to 75 μm. The thickness of the functional layers and of the replication layer together lies in the range of from 0.5 μm to 20 μm, preferably 1 μm to 5 μm.

The replication layer 4 is structured on its surface by known processes. For this purpose, for example, as a replication layer 4, a thermoplastic replication varnish is applied by printing, spraying or varnishing, and a relief structure is molded into the replication varnish by means of a heated die or a heated replication roller.

The replication layer 4 may also be a replication varnish that is UV-curable, and that is structured, for example, by a replication roller. However, the structuring may also be produced by UV irradiation through an exposure mask. In this way, the relief structures 5 and 6 can be shaped into the replication layer 4. The relief structures 5 and 6 may be, for example, the optically active structures of a hologram or of a Kinegram® security feature.

In order to produce the partial HRI layers 7, a layer made of a highly refractive material is first applied over the full surface area of the replication layer 4. The material may be zinc sulfide, niobium pentoxide or titanium dioxide. This may be effected, for example, by vapor-coating the surface of the replication layer with the material.

The layer thickness of the HRI layer is preferably between 25 nm and 500 nm. The layer thickness depends on the properties to be achieved, such as, for example, a particular coloring. Thinner layers in the range 45 nm to 65 nm appear rather neutral in respect of color, whereas thicker layers may have pronounced color effects, depending on the thickness.

The HRI layer 7 must then be removed, with the result that it is retained only in a first partial region 9 and is removed from the replication layer 4 in a second partial region 10. It has been found that treatment with an alkaline solution can cause the HRI layer 7 to separate physically. This effect is very pronounced, in particular if ZnS is used for the HRI layer. In this case, the HRI layer 7 is not chemically dissolved by the alkaline solution, but flakes off, and can easily be removed, in the form of fine flakes, by mechanical action. Even a thin covering layer of a varnish, of some 100 nm, which keeps the alkaline solution away from the HRI layer 7, prevents this effect.

The cause of the physical separation of the HRI layer 7 lies in the structure of the HRI layer 7. Typically, the HRI layer 7 is vapor-deposited at relatively high application rates (more than 1000 nm/min). The forming HRI layer 7 is not perfectly closed, but has fine pores. Furthermore, there is no monocrystalline phase, but at least one polycrystalline or partially amorphous layer. For example, ZnS is substantially not soluble in water or alkaline solution, which is also true for the vapor-deposited HRI layer 7. If an alkaline solution is allowed to act upon the HRI layer 7, however, it penetrates at least partially into the layer and forms zinc hydroxo complexes. As a result, a mechanical stress is produced in the HRI layer 7, which can result in the HRI layer 7 flaking off. Furthermore, the penetration of moisture into the HRI layer 7 may reduce the interfacial adhesion to the replication layer 4, thereby further promoting the flaking-off process.

Figure 3:
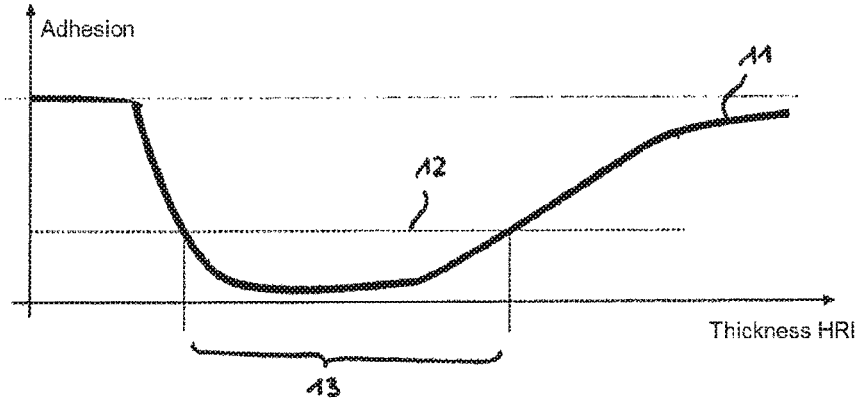
FIG. 3 a schematic graphical representation of the influences upon the adhesion of an HRI layer in the case of physical separation by means of an alkaline solution.

FIG. 3 shows schematically the dependence of the flaking-off phenomenon on the layer thickness of the HRI layer 7. Particular process conditions (alkaline solution concentration, composition of the alkaline solution, temperature, treatment time, etc.) have been assumed in this case. In the case of small thicknesses of the HRI layer 7, on the one hand the microcrystalline structure of the vapor-deposited layer is different from the structure of a thicker HRI layer 7 and, on the other hand, a sufficient mechanical stress can build up only to a limited extent. For the process of flaking-off, therefore, there is a lower limit in respect of the thickness of the HRI layer 7. On the other hand, in the case of thicker layers of many 100 nm, both the microcrystalline structure of the HRI layer 7 and the inherent stability of the HRI layer 7 have the effect that the HRI layer 7 can no longer be easily removed.

FIG. 3 illustrates the adhesion capacity of the HRI layer 7 on a substrate (typically the replication layer 4) as a function of the layer thickness, under the action of alkaline solution (process characteristic 11). The course of this curve will differ according to the configuration of the influencing factors. The dynamics of the flaking-off process are determined substantially by mechanical action upon the HRI layer 7 during or after the action of the alkaline solution. If flakes that form are removed mechanically, uncontrolled flaking-off and unwanted undermining of the HRI layer 7 by the alkaline solution are prevented. Flakes that have already separated off are also prevented from remaining on the replication layer. The process characteristic 12 indicates that layers having an adhesion capacity below a particular threshold can be removed mechanically. A layer thickness range 13 thus results in which it is possible to remove the HRI layer 7 using the process described.

The actual course of the characteristic 11 in this case depends on a multiplicity of influencing factors. Of importance are firstly mechanical properties and the thickness of the carrier foil 1.

The replication layer 4 also influences the characteristic 11. Of importance here, in particular, are the chemical composition, any pre-treatment of the surface of the replication layer (SiOx, Cr seeding, corona, plasma, application of flame, etc.) and the configuration of the relief structures 5 and 6 (spatial frequency, relief depth, depth-to-width ratio, profile shape of the relief structure, etc.).

The manner of application of the HRI layer 7, in particular vapor deposition, also influences the adhesion of the HRI layer under the action of alkaline solution. Significant influencing variables in this case are the vapor deposition rate, and the material used for the HRI layer 7, the layer thickness, the temperature and vacuum conditions during the vapor deposition, as well as the conditions of the aforementioned pre-treatment (for example, plasma).

Finally, the interfacial adhesion is also influenced by the chemical composition, concentration, temperature and duration of action of the alkaline solution upon the multilayer body 100. The course of the process is also influenced by mechanical actions during and/or after the alkaline solution treatment, the structure of the surface, stresses in the carrier foil 1, as well as various pre-treatment techniques prior to the alkaline solution treatment.

An important target variable in the setting of the process parameters is constituted by the characteristic of the flaking-off (size and shape of the flakes formed, stability of regions, optionally covered with a protective varnish, against undermining by the alkaline solution, ease of removal of the flaked-off flakes, etc.), as well as the selectivity of the influence of the relief structures 5 and 6 upon the adhesion of the HRI layer 7.

Preferably, alkaline solution concentrations in the range 0.01% to 15% are used. The more preferred ranges depend, however, on the type of alkaline solution used, and on the process variant used. What is important in this case is that a pH value of more than 10 be set. A suitable alkaline solution is, for example, metal hydroxide, such as, for example, NaOH or KOH, but also sodium bicarbonate, TMAH (tetramethylammonium hydroxide) or EDTA ($Na_2EDTA$) (ethylenediaminetetra-acetate). The temperatures are preferably in the range 10° C. to 80° C. Action times may preferably be in the range of a few seconds, but may also be up to some minutes.

The separation of the HRI layer 7 may be assisted by mechanical action such as, for example, by brushing or wiping with sponges or a wiping roller. The same effect may be achieved by a strong flow application in a bath or by spraying. Moreover, the removal of the HRI layer 7 may be assisted by ultrasound.

Various possibilities exist, which may be applied either individually or in combination, to ensure only partial separation of the HRI layer 7 in the regions 10.

Figure 4:
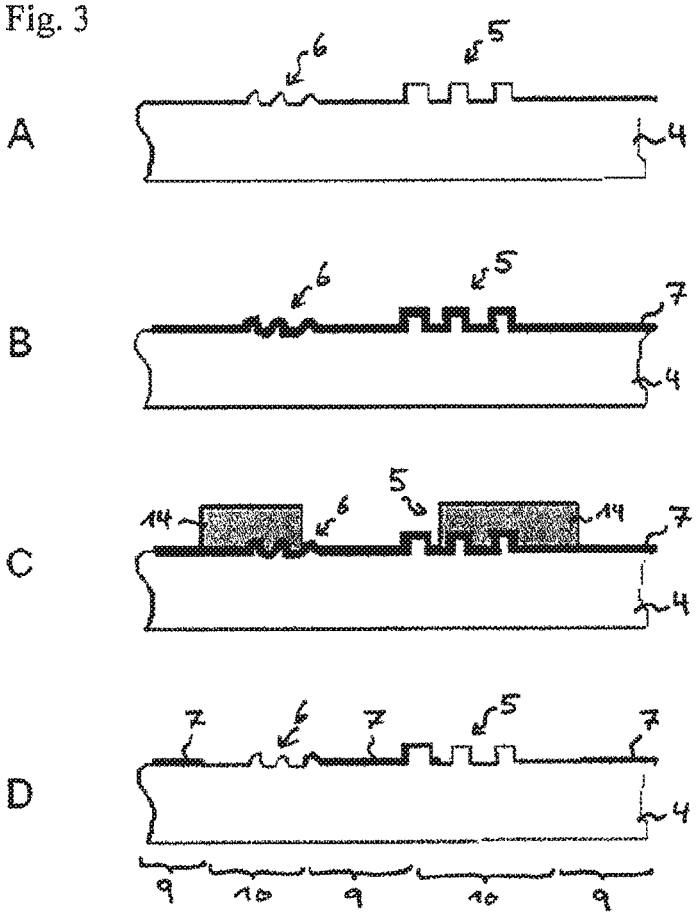
FIG. 4 a schematic representation of a section through a multilayer body during various stages of the execution of a first embodiment example of a process for producing the multilayer body.

A first process variant is represented in FIG. 4. This shows representations of a portion of a section through a multilayer body 100 during various process steps. Only the replication layer 4 is shown in each case. Clearly, in this case likewise, the carrier foil 1 and the functional layers 2 and 3 may also be present. FIG. 4A shows the replication layer 4, into which the relief structures have already been introduced by means of the techniques described above. The HRI layer 7 is then vapor-deposited or sputtered over the full surface area of the replication layer 4, in order to achieve the intermediate product shown in FIG. 4B. As shown by FIG. 4C, an alkaline solution layer 14 is then printed on to the HRI layer 7, in the regions 10. The alkaline solution can thus only act locally where the alkaline solution layer 14 is in direct contact with the HRI layer 7, with the result that the latter is separated from the surface of the replication layer 4 only in the regions 10, and is retained in the regions 9. Following the action of the alkaline solution, the latter is washed off, and the separation of the HRI layer 7 in the regions 10 is assisted by wiping, brushing, ultrasonic treatment or flow application of the washing medium, with the result that the structure shown in FIG. 4D is ultimately obtained.

Flexographic printing or gravure printing is preferably used to print on the alkaline solution. With these printing methods, it is possible to achieve a resolution (cleanly printed lines, both positive and negative) of the printed-on alkaline solution layers 14 of from 0.1 nm to 0.2 mm. The register tolerance of the remaining HRI layers 7 that can be achieved in the regions 9 in relation to the relief structures 5 and 6 is approximately 0.5 mm. The register tolerance in this case depends substantially on the printing technique used, as well as on the dimensional stability of the substrate (i.e. the capacity to resist deformations caused by thermal and/or mechanical influences during the processes) and the system technology used. Significantly lesser register tolerances can thus also be achieved.

In order to render the alkaline solution printable, additives may be added to it, such as, for example, $CaCO_3$ and/or wetting agents. For this process variant, it is possible to use, for example, caustic soda solution, in a concentration of 15%.

Figure 5:
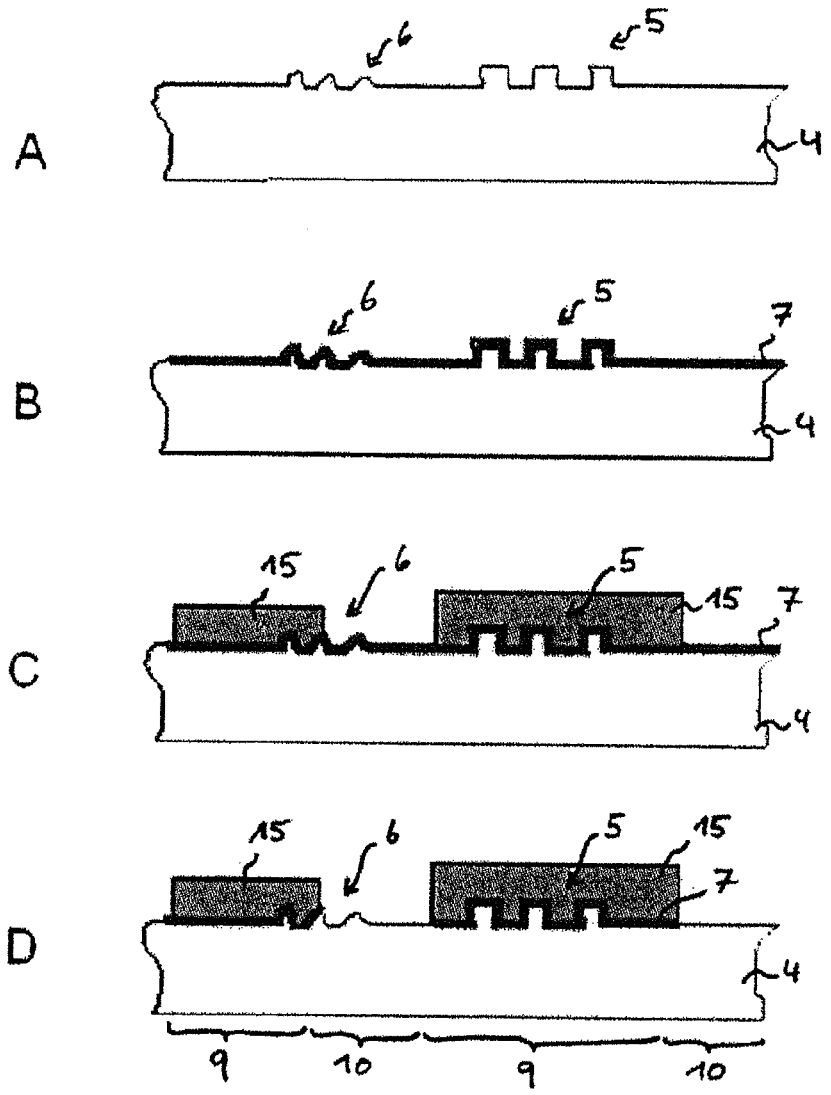
FIG. 5 a schematic representation of a section through a multilayer body during various stages of the execution of a second embodiment example of a process for producing the multilayer body.

A second embodiment example of the process is shown in FIG. 5.

This shows representations of a portion of a section through a multilayer body 100 during various process steps. Only the replication layer 4 is shown in each case. Clearly, in this case likewise, the carrier foil 1 and the functional layers 2 and 3 may also be present. FIG. 5A shows the replication layer 4, into which the relief structures have already been introduced by means of the techniques described above. The HRI layer 7 is then vapor-deposited or sputtered over the full surface area of the replication layer 4, in order to achieve the intermediate product shown in FIG. 5B. A protective varnish 15 is then printed on to the regions 9, in order to protect the HRI layer 7 there against the action of the alkaline solution (FIG. 5C). In the subsequent alkaline solution treatment, for example in a bath, the HRI layer 7 separates from the replication layer 4 only in the unprotected regions 10, with the result that, following washing and mechanical treatment in the manner described, the product shown in FIG. 5D is obtained.

Preferably, flexographic, offset or gravure printing is used to apply the protective varnish. With this printing method, it is possible to achieve a resolution of the printed-on protective layer of from 0.1 mm to 0.2 mm. The register tolerance of the remaining HRI layers 7 that can be achieved in the regions 9 in relation to the relief structures 5 and 6 is approximately 0.1 mm to 0.2 mm, while a register tolerance of 0.025 mm can be achieved in relation to structures possibly still present in the functional layers. The register tolerance in this case depends substantially on the printing technique used. In addition, the resolution and register maintenance of the remaining HRI layers are influenced by remaining flakes of the HRI material at the printing edge, and by a possible downward movement of the protective varnish layer 15.

For this process variant, caustic soda solution having a conductivity of approximately 30 mS/cm, thus having a pH value of approximately 13 at a temperature of 40° C. or, alternatively, caustic soda solution having a conductivity of 80 mS/cm, thus having a pH value of approximately 13.5 at a temperature of 22° C., is preferably used as alkaline solution.

After the partial removal of the HRI layer 7, the protective varnish 15 may be left on the remaining HRI layer or, alternatively, removed again for example by treatment with solvent. If the protective varnish is to remain on the multilayer body 100, then the protective varnish can take on yet further functions, for example act as an adhesive, or have at least one color which can be UV-excited or is visually perceptible, or serve as a protective layer for further process steps.

Figure 6:
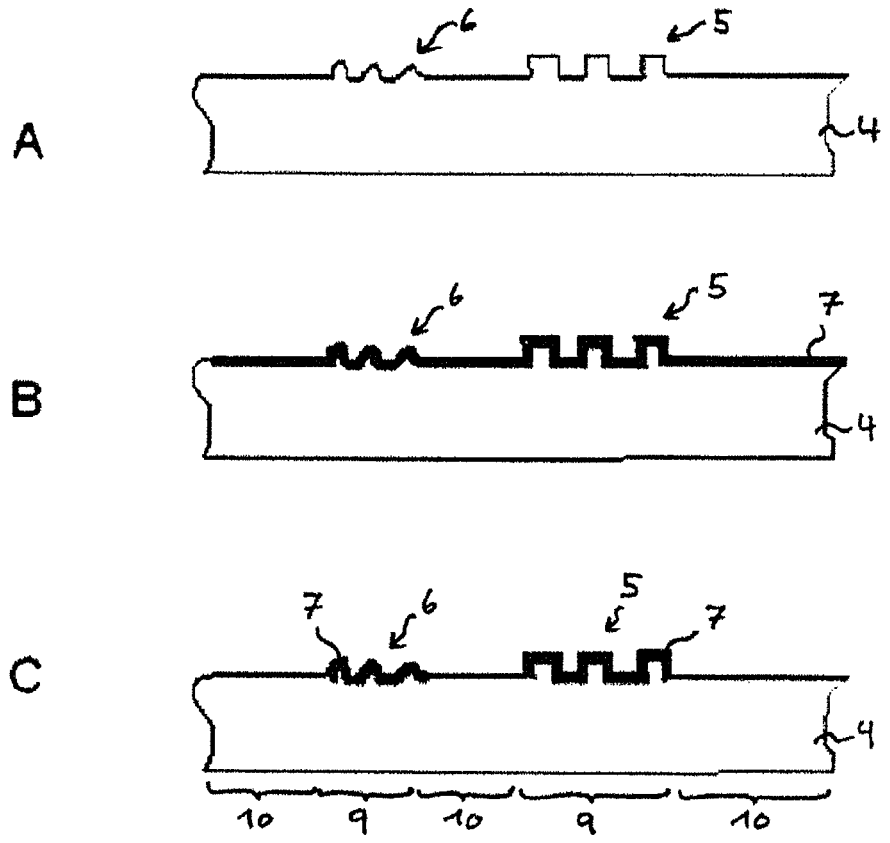
FIG. 6 a schematic representation of a section through a multilayer body during various stages of the execution of a third embodiment example of a process for producing the multilayer body.

A third embodiment example of the process is shown in FIG. 6. This shows representations of a portion of a section through a multilayer body 100 during various process steps. Only the replication layer 4 is shown in each case. Clearly, in this case likewise, the carrier foil 1 and the functional layers 2 and 3 may also be present. FIG. 6A again shows the replication layer 4, into which the relief structures have already been introduced by means of the techniques described above. The HRI layer 7 is then vapor-deposited or sputtered over the full surface area of the replication layer 4, in order to obtain the intermediate product shown in FIG. 6B.

It has been found that the adhesion of the HRI layer 7 on the replication layer 4, and in particular its flaking-off behavior under the action of alkaline solution, is influenced to a large extent by the type of the relief structures 5, 6 of the replication layer 4. Thus, the type of the relief structures 5, 6 can be utilized to selectively influence the flaking-off behavior.

Thus, it appears that, in particular, diffractive structures 5, 6 having a high depth-to-width ratio and/or a high spatial frequency result in a significantly increased adhesion of the HRI layer 7. The depth-to-width ratio is preferably selected in the range of from 0.1 to 1.0. The spatial frequency is preferably between 1000 and 4000 l/mm.

If alkaline solution is applied to the HRI layer 7, the HRI layer 7 begins to break up outside of the regions 9 having a high depth-to-width ratio, and can be removed mechanically. It is particularly advantageous in this case to select the pH value of the alkaline solution within the following range: 11 to 13.

After this process step, the HRI layer is only present in the regions 9 in perfect register in relation to the relief structures 5, 6, as shown by FIG. 6C. Highly filigreed patterns are also possible in this case.

A combination of various effects may be responsible for this behavior. Firstly, the enlarged surface in the region of the relief structures 5, 6 results in an increased interfacial adhesion between the HRI layer 7 and the replication layer 4. The propagation of the flaking-off of the HRI layer 7 is additionally prevented by the relief structures 5, 6, in that they act as predetermined breaking points. Moreover, the configuration of the stress in the HRI layer 7 that is induced by the alkaline solution is altered, with the result that the forces promoting the flaking-off of the HRI layer 7 are distributed differently. The microcrystalline structure of the HRI layer 7, which is formed upon vapor deposition, is also different, owing to the differing wall inclinations of relief structures 5, 6 and smooth surfaces.

For this process step, relatively low alkaline solution concentrations have proved effective. For NaOH as an alkaline solution, concentrations of approximately 0.02-0.06%, thus a pH value of approximately 12.1 to 12.8, and a temperature of approximately 35-55° C., have been determined as advantageous. At high concentrations (>0.5%), the flaking-off of the HRI layer 7 is effected in a less controlled manner, and fractures may also occur in the regions 9 to be retained.

A suitable mechanical action is important for precise breaking away of the HRI layer 7. By the removal of flakes that are already small, the propagation of the flaking-off process is controlled. Spraying jets (continuous or pulsed), ultrasound, or also scrubbing rollers rotating in various directions (brushes, cloths, sponges) or devices in the manner of an orbital sander have proved effective.

Relief structures 5, 6 in the form of grating structures (1-dimensional or 2-dimensional), having periods in the range of <3 μm, have proved particularly effective for increasing the adhesion of the HRI layer 7 to the replication layer 4. The profile shapes of the grating structures may be sinusoidal, rectangular or triangular, but may also have more complex profile shapes. Furthermore, the aspect ratio is preferably greater than 0.1, and in particular greater than 0.15.

Besides ordered grating structures, stochastic microstructures, for example matte structures, in the relief structures 5, 6 are also particularly effective in increasing the interfacial adhesion.

Figure 7:
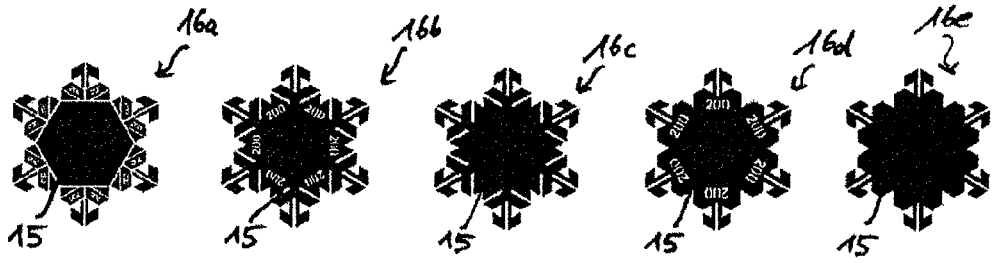
FIGS. 7-13 various design and security elements that can be produced by means of various embodiment examples of a process for producing multilayer bodies.

FIG. 7 shows a plurality of motifs 16*a*-16*e* produced by means of the second embodiment example, described above, of the process. A protective varnish 15 was applied, by means of gravure printing, to a replicated replication layer 4 that had ZnS vapor-deposited over its full surface area. The black-colored regions of the motifs 16*a-e* indicate the protective varnish 15. The removal of the HRI layer 7 outside of the overprinted regions is effected by the action of an alkaline solution bath and subsequent rinsing by means of spraying jets and wiping by means of brushes.

Depending on the printing varnish 15 used, the printing method and the process control for removal of the HRI layer 7, certain limitations may have to be taken into account. Thus, it has been found that a negative (non-printed) surface area extent must be at least 0.8 mm, and a positive (printed) surface area extent must be at least 0.4 mm. Depending on the process control, however, values may also be significantly below these values. Small subjects in the motifs 16*a-e* must be joined to each other, and may not stand free, since otherwise there is the risk of the HRI layer 7 breaking away. The embodiment example described is therefore not suitable for subjects with fine detail. In the case of the motifs 16*a-e* shown, this applies in particular to the motifs 16*a* and 16*b*. For these motifs, the other methods described here are more suitable.

Besides protecting the HRI layer 7 against the action of the alkaline solution, the printing varnish 15 may also perform additional functions. For example, the printing varnish 15 may serve to promote adhesion between the HRI layer 7 and an adhesive layer. Also possible is an additional function as a mechanically stabilizing layer, in order to avoid a degradation of the visual impression of the optical effects in the case of application to a substrate or laminated in a layer composite (for example, in the case of plastic cards made of polycarbonate, PET or PVC). The protective varnish 15 may additionally serve as an adhesive for the subsequent application of the multilayer body 100 to a substrate or insertion into a layer composite.

The printing varnish 15 may be a system that dries physically, or undergoes chemical cross-linking or that is cured by means of radiation, in particular ultraviolet or electron radiation.

Furthermore, the printing varnish 15 may be colored by means of dyes or pigments, in order to improve the contrast and the perceptibility of the optical effects of the HRI layer 7. Here likewise, however, the printing varnish 15 may be removed again, as described.

Figure 8:
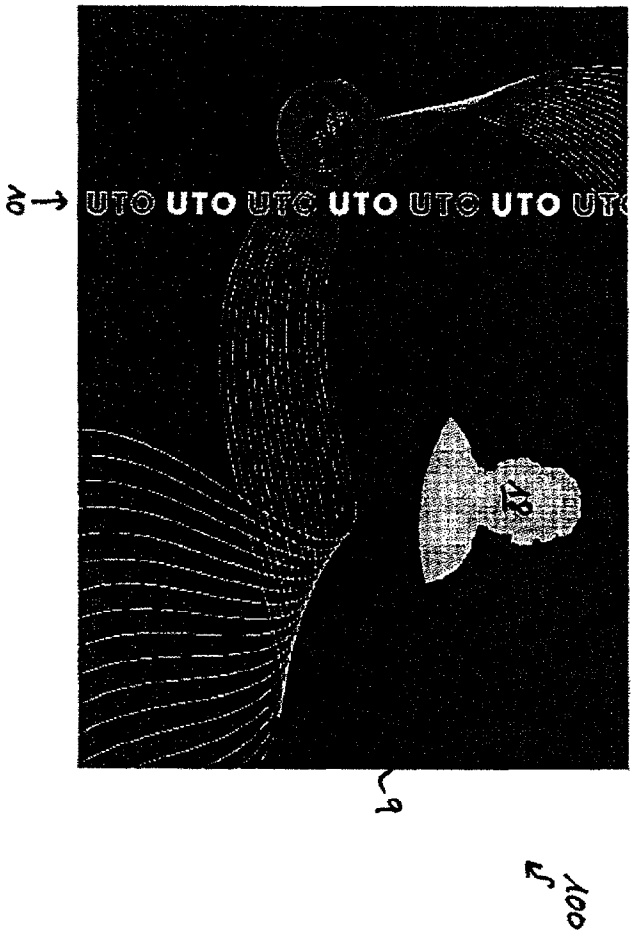

FIG. 8 shows a multilayer body 100, produced according to a fourth embodiment example of the method, and which serves as a KINEGRAM® TKO for protecting the data pages of a passport. A KINEGRAM® TKO is a transparent protective layer having security features which is applied as a foil laminate or as a transfer element to a substrate.

In this embodiment example, likewise, as already described, the replication layer 4 is provided with the relief structures 5, 6 and with a vapor deposition of ZnS over its full surface area in order to form the HRI layer 7. The HRI layer 7 is then coated with a photoresist over its full surface area. However, it is also possible for the application to be effected only partially, for example by means of a printing method. This is particularly appropriate in those cases in which larger regions without an HRI layer 7 are to be produced.

The photoresist may be, for example, a positive photoresist, such as AZ 1512 or AZ P4620 by Clariant or S1822 by Shipley, which is applied to the first layer 3 m with an areal density of from 0.1 $g/m^2$ to 50 $g/m^2$. The layer thickness is governed by the desired resolution and the process. Preferred weights per unit area are in the range of from 0.2 $g/m^2$ to 10 $g/m^2$.

Following application, the photoresist is exposed to light by means of a mask, wherein one of the functional layers 2 and 3 may serve as a mask, for example if these layers 2, 3 contain a corresponding modification, coloration or pigmentation that can serve as a masking of a light-exposure wavelength, and removes the light-exposed regions of the photoresist by development. The HRI layer 7 is then treated with alkaline solution in those regions in which the photoresist has been removed, wherein the remaining photoresist serves as a protective layer against the alkaline solution. The HRI layer 7 is thus removed only in the regions in which the photoresist has been exposed to light and/or, in the case of partial printing, has not been applied.

In a manner analogous to the protective varnish 15, the photoresist may take on the further functions described in connection with the latter, but optionally may also be removed again in a further process step.

FIG. 8 shows a schematic, top-view representation of the multilayer body 100 for passport applications. The regions 9 represented in black show a full surface-area covering with the HRI layer 7, whereas the HRI layer 7 is completely removed in the regions 10 represented in white. Regions represented in grey (world map 17, portrait 18) show a partial surface-area covering with the HRI layer 7 that is below the resolution capability of the human eye. In the stylized world map, in the form of a 2-dimensional fine grid, and in the portrait 18, in the form of a microprint with locally varying line boldness.

This exemplary process exploits, in particular, the high resolution that can be achieved in the case of photo-structuring by means of a photoresist. Thus, for example, photoresists can be structured with down to sub-micrometer resolution, wherein the resolution that can be realized is determined substantially by the thickness of the photoresist, the resolution of the light exposure mask and the process control. Owing to the binary design of the photoresist as a protective varnish, a high resolution of the partial HRI layer 7 can also be ensured through appropriate process control. In particular, a resolution of the HRI layer 7 of 0.03 mm or better can be achieved with the process described. The register tolerance that can be achieved in relation to relief structures 5, 6 is approximately 0.1-0.3 mm, while the register tolerance of the HRI layer 7 of 0.01 mm or better can be achieved in relation to further functional layers, provided that the photoresist itself remains as a functional layer or the functional layers 2, 3 are used as a mask.

Furthermore, it is possible to insert an individual identification, for example a consecutive number. For this purpose, the photoresist is exposed to light by a laser or a controllable mask.

Furthermore, the photoresist may also have a single-colored or multicolored coloration (for example, by means of dissolved dyes or pigments), in order to improve the contrast and the perceptibility, or also to serve as a further security element.

In this embodiment example, caustic soda solution having a conductivity of approximately 12 mS/cm, thus a pH value of approximately 12.6, at a temperature of 45° C., is used for partial removal of the HRI layer. Under these conditions, the caustic soda solution can serve simultaneously to develop, or remove, the light-exposed photoresist, with the result that a particularly simple process control is obtained.

Figure 9:
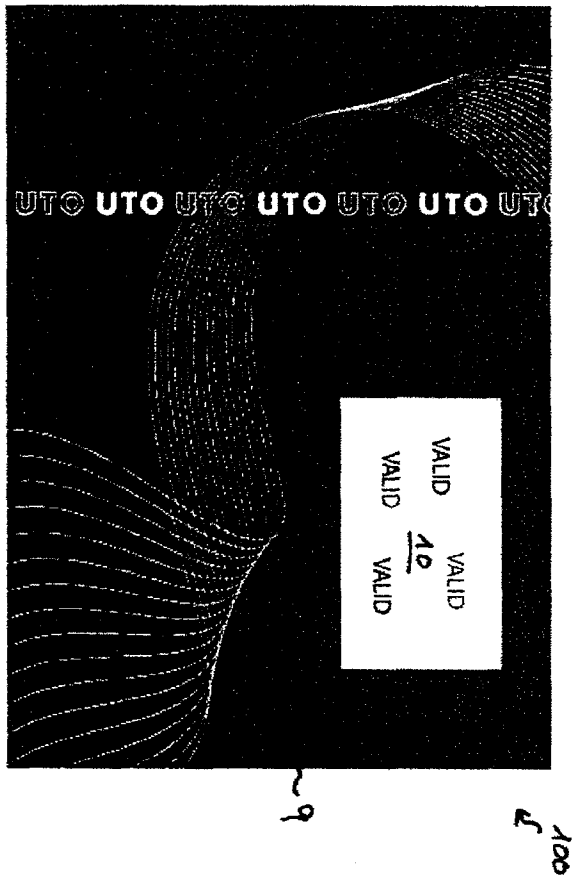

FIG. 9 shows a further embodiment example of a multilayer body 100 that can be produced by means of the second embodiment example, described above, of the process. The multilayer body 100 again has a Kinegram®, and serves to protect the data pages of a passport.

Again, the regions 9 colored black show a full surface-area covering with the HRI layer 7, whereas the HRI layer 7 has been completely removed in the white regions 10. In the upper-right corner there is a rectangle, in which the HRI layer 7 has been removed over a large surface area. The HRI layer 7 was removed in this region in order to ensure high transparency to UV radiation at a wavelength of 254 nm. On the data page to be protected of the passport, this region has UV-active pigments which are intended to be activated at this wavelength for the purpose of verification.

In this rectangular region there are also four inscriptions, "VALID", which each have an HRI layer 7. Each of the inscriptions is backed in register with another color, e.g. red, green, yellow and blue, that is fluorescent under UV irradiation (e.g. 365 nm). The respective protective varnish 15 that was used to protect the HRI layer 7 against the alkaline solution for removal of the HRI layer 7 thus has a further function in each case, and is in register in relation to the HRI layer 7. It is only in these regions having the HRI layer 7 that the diffractive structures molded in the replication layer 4 are also optically active.

The additional functions of the protective varnish 15 may differ. For example, here, the protective varnish 15 may be provided with UV-active pigments, have nanoparticles or upconverters. However, it may also be a protective varnish 15 having OVI pigments, having thermochromic or photochromic dyes. Moreover, the protective varnish 15 can also be colored in the visual range.

The protective varnish may be applied by a great variety of printing methods, e.g. by means of gravure printing, offset printing, flexographic printing or screen printing. A printing by means of digital printing is also possible, for example inkjet, wherein in this case, in particular, an individual identification may be applied, which is also manifested in the partial configuration of the HRI layer 7.

Combinations of various printing techniques and printing colors are particularly advantageous.

Figure 10:
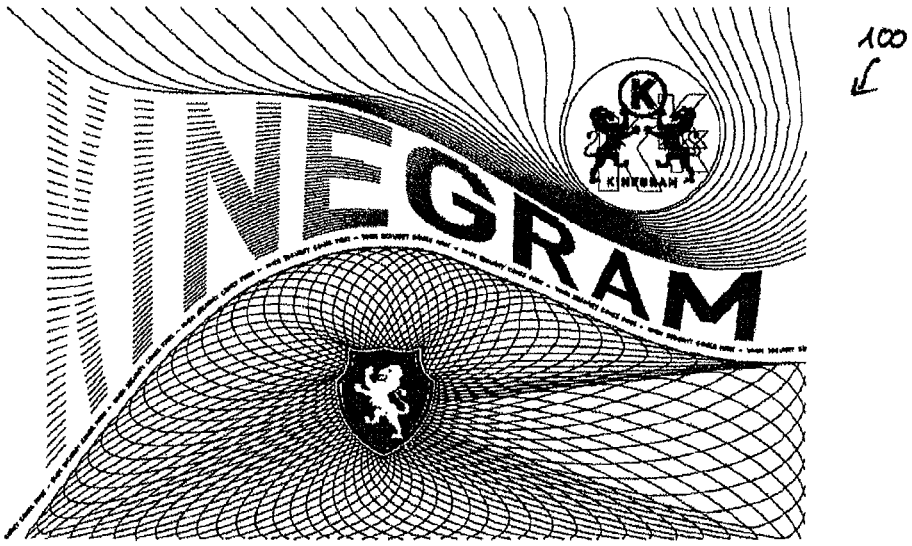

FIG. 10 shows a multilayer body 100 having a Kinegram® for a card application. The linear design elements having typical line widths of around 50 μm are shown. The background does not have any structures, and is substantially a mirror. The third embodiment variant, described above, of the process is particularly suitable for producing this embodiment example of the multilayer body 100, i.e. the HRI layer 7 is structured on the basis of the structures introduced into the replication layer 4—in this case the linear design elements—without the use of a protective varnish 15 or photoresist. The process parameters stated above are suitable for the embodiment example shown here. The advantages of this example include the very high register maintenance of the HRI layer in relation to the diffractive design, while affording an unimpeded view of the substrate in the regions away from the HRI layer.

Figure 11:
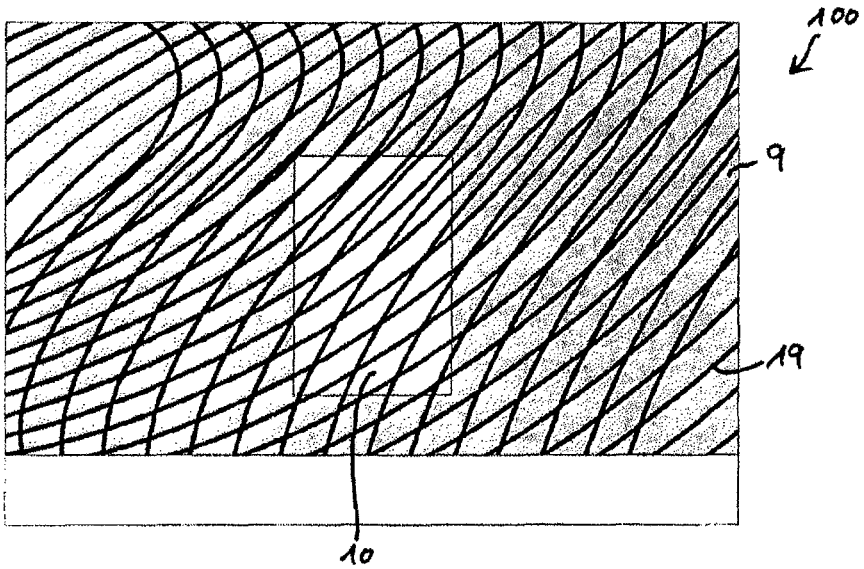

FIG. 11 shows a further embodiment example of a multilayer body 100, which comprises a Kinegram® for a card application. The grey-backed surface area 9 has been protected by a printing varnish 15, according to the second embodiment example, described above, of the process, and has a full surface-area HRI layer 7. The black curved lines 19 have diffractive structures. In the central rectangle 10, the HRI layer 7 is entirely absent in the background without diffractive structures, but the diffractive structures of the curved lines 19 are backed in perfect register with an HRI layer 7. In this embodiment example, the alkaline solution treatment was effected with NaOH, with a conductivity of 2 mS/cm, thus a pH value of approximately 11.9, and a temperature of 45° C.

The KINEGRAM® is presented to a viewer in its entirety, without interruptions, over the entire surface area. However, the background of the central rectangle has no HRI layer 7, and allows an unimpeded view of the substrate.

This combination may also be applied to protect in a targeted manner partial regions of a KINEGRAM®, the HRI layer 7 of which regions are not resistant to the action of an alkaline solution, because of the structures present in these regions, while the remaining regions have the HRI layer 7 in register in relation to the diffractive structures.

Figure 12:
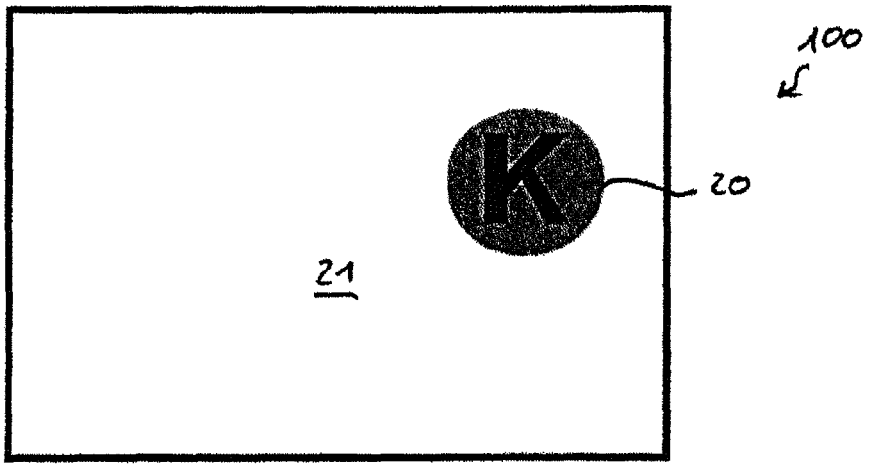

FIG. 12 shows a further embodiment of a multilayer body 100 having a KINEGRAM® TKO for a card application. The entire surface area has diffractive structures, wherein only a partial region 20 (circle with letter K) is represented. In this region, there are high-frequency linear grating structures, realizing a zero-order diffractive structure.

In order to produce an optimum optical effect, the layer thickness of the HRI layer 7 in the region 20 of the zero-order diffractive structure has to be relatively great, with the result that an HRI layer 7 of this thickness applied over the full surface area would result in a disruptive coloring in the surrounding regions, owing to the interference in the HRI layer 7. The diffraction efficiency of other structures for producing first diffraction order or higher diffraction order effects (rainbow effects, but also, for example, diffractive structures for producing macroscopic relief effects) may also decrease. An optimally designed feature for the card must therefore have an increased layer thickness in the region 20 of the circle, as compared with the further region 21, but only there. The layer thickness in the region 20 is preferably 70 nm to 200 nm.

In order to produce such an HRI layer 7 having a varying layer thickness, an HRI layer 7, having a layer thickness that corresponds to the target difference of the two thicknesses in the two regions 20, 21, is applied to the replication layer 4, in a first step. Utilizing the greater adhesion capacity of the high-frequency grating structure, thus according to the third embodiment, described above, of the process, this first HRI layer 7 is removed in the surrounding region 21, with maintenance of register. In a second step, a second vapor deposition with HRI material is then performed over the full surface area, with the result that the respectively optimum layer thickness is achieved in both the background 21 and the circle 20.

Application and removal of HRI layers 7 may optionally be repeated a number of times, in order to create a plurality of regions having respectively differing layer thicknesses of the HRI layer 7.

Figure 13:
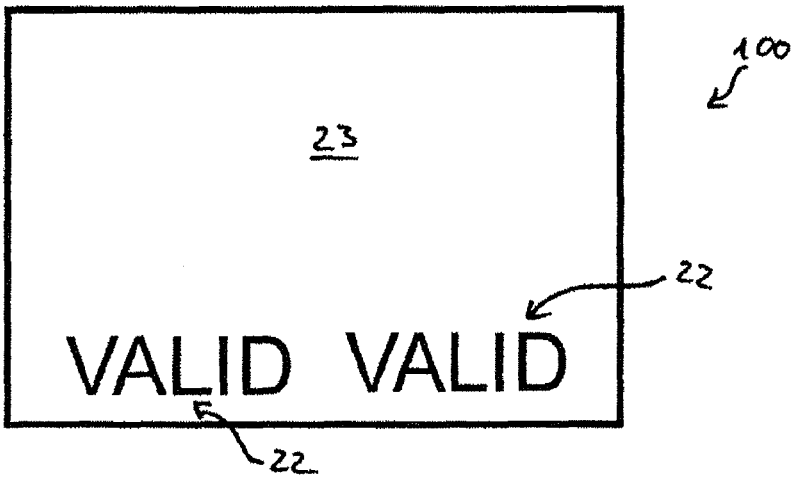

FIG. 13 shows a further embodiment of a multilayer body 100 having an HRI layer 7 having locally differing layer thicknesses. The multilayer body 100 again comprises a KINEGRAM® TKO for a card application. It is only as a result of locally differing configuration of the layer thickness of the HRI layer that the inscription "VALID" 22 appears in reflection, in a predefined interference color, while the background 23 continues to appear color-neutral.

Figure 14:
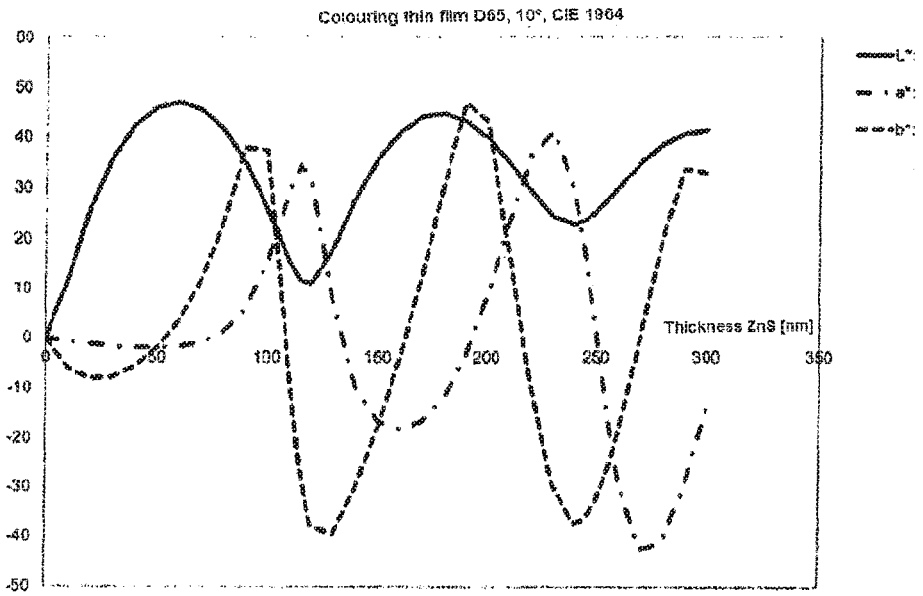
FIG. 14 a schematic graphical representation of the dependence of the optical properties of an HRI layer upon the layer thickness.

The layer thickness of the HRI layer 7 determines the color impression perceived in reflection by a viewer. The relationship between layer thickness and color impression is represented in graph form in FIG. 14. The three graphs in this case show simulated lab values in reflection under D65 illumination and a standardized viewer (10°, CIE1964).

In the case of very small layer thicknesses, of from 10 nm to 40 nm, the HRI layer 7 appears bluish. Standard thicknesses of around approximately 55 nm are typically selected, such that the appearance is color-neutral. If the layer thickness is increased, various color impressions (yellow, orange, green, blue, etc.) can be produced in the thickness range of from 65 nm to several 100 nm. The processes described above now make it possible to produce regions having selectively differing color impressions.

In a first step, an HRI layer 7 having a first layer thickness is applied over the full surface area, and is removed again in the background 23 of the VALID inscription 22. Full surface-area vapor deposition of a second HRI layer 7 achieves the effect that the addition of the two layer thicknesses is present in the inscription 22, and the desired color-neutral layer thickness is present in the background 23.

The color impression in reflection serves as an additional security feature for the verification of genuineness. Unlike a color that is merely printed on, the color impression is perceivable mainly in reflection, owing to the thickness of the HRI layer 7. The coloring may be varied further by application of a metal layer such as, for example, a chromium layer. In the case of very thin configurations of the metal layers, of a few nanometers, a closed layer is not realized, with the result that such metal layers do not constitute protection against the action of alkaline solution. Such layers can thus be removed together with an HRI layer 7 that is underneath. In the case of thicker metal layers, the metal layer can be removed in a first step, and the metal layer can then be used as a mask for the removal of the HRI layer 7 underneath.

Figure 15:
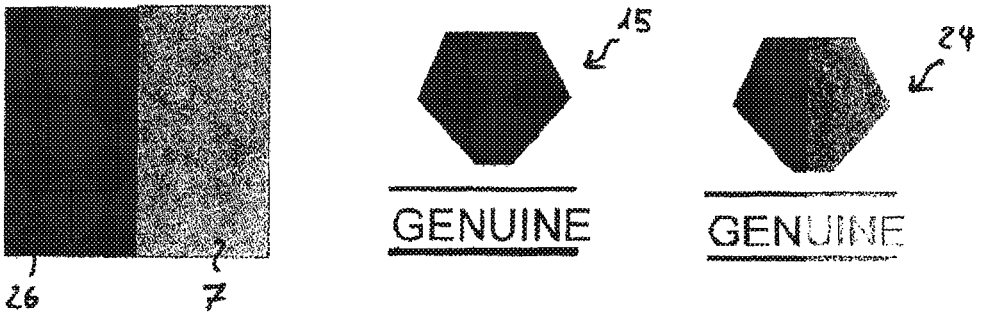
FIG. 15 a further design and security element that can be produced by means of an embodiment example of the process for producing multilayer bodies.

A further motif 24 for a multilayer body 100, which can be produced by means of the process described above, is shown schematically in FIG. 15. The motif 24 comprises a combination of metallic regions and regions having an HRI layer 7, which are partially structured in exact register in relation to each other. To create the motif 24, as shown on the left side of FIG. 15, an arrangement 25 of an HRI layer 7 and a metal layer 26 is first created by vapor deposition on to a substrate. This arrangement may be effected, for example, by partial vapor deposition or by full surface-area vapor deposition and partial structuring of the two layers. Then, as shown in the center of FIG. 15, the protective varnish 15 is applied in the printed image represented. Following alkaline solution treatment, the motif 24 represented on the right in the figure is obtained.

Since only one single printing step is performed, and since the regions of the metal layer 26 not protected by the protective varnish 15 and the HRI layer 7 are removed at the same time by the alkaline solution treatment, the transitions between metallic reflection layer 26 and HRI layer 7 are perfectly matched to each other. If the metal layer cannot be structured by an alkaline solution, two separate treatments, with differing media, may also be performed. In this case, the layers 7, 26 may be disposed next to each other or, also, may overlap.

In this embodiment example, the alkaline solution treatment is performed with caustic soda solution having a conductivity of 12 mS/cm, thus a pH value of approximately 12.7, at a temperature of 45° C. Alternatively, it is possible to use caustic soda solution having a conductivity of 5 mS/cm, thus a pH value of approximately 12.3, at 55° C., or a caustic potash solution having a conductivity of 20 mS/cm, thus a pH value of approximately 13, at a temperature of 30° C.

LIST OF REFERENCE NUMBERS

1 carrier foil
2 functional layer
3 functional layer
4 replication layer
5 relief structure
6 relief structure
7 HRI layer
8 transparent protective varnish
9 region
10 region
11 process characteristic
12 characteristic
13 thickness region
14 alkaline solution layer
15 protective varnish
16 motif
17 world map
18 portrait
19 line
20 region
21 background
22 inscription
23 background
24 motif
25 arrangement
26 metal layer
100 multilayer body

The invention claimed is:

1. A process for producing a multilayer body comprising:

applying a High Refractive Index (HRI) layer which consists of a material having a high refractive index over an entire surface area of a substrate;

applying an alkaline solution on at least one partial region of the HRI layer such that the alkaline solution does not chemically dissolve the HRI layer in the at least one partial region, but, instead, causes the HRI layer in the at least one partial region to flake off from the surface area of the substrate; and completely removing the flaked off HRI layer in the at least one partial region by a mechanical process, wherein the alkaline solution has a pH value of at least 10, and wherein the treatment with the alkaline solution is effected at a temperature of from 10° C. to 80° C.

2. A process according to claim 1, wherein the material having a high refractive index is selected from the group zinc sulfide, niobium pentoxide, titanium oxide.

3. A process according to claim 1, wherein the alkaline solution is selected from the group sodium hydroxide, potassium hydroxide, sodium bicarbonate, tetramethylammonium hydroxide, sodium ethylenediaminetetra-acetate.

4. A process according to claim 1, wherein, to aid the separation of the HRI layer, a mechanical treatment of the HRI layer is effected during and/or after the treatment with the alkaline solution.

5. A process according to claim 4, wherein the mechanical treatment comprises brushing, and/or wiping with a sponge and/or a wiping roller, and/or an ultrasonic treatment, and/or application of a flowing and/or sprayed liquid to the HRI-layer.

6. A process according to claim 1, wherein, a mask layer, to protect at least one partial region not to be removed of the HRI layer, is applied to the HRI layer before the treatment with the alkaline solution.

7. A process according to claim 6, wherein the mask layer is applied by gravure printing, offset printing, flexographic printing, screen printing or inkjet printing of a protective varnish on to the HRI layer.

8. A process according to claim 7, wherein the protective varnish is a varnish that dries physically or undergoes chemical cross-linking or radiation curing.

9. A process according to claim 7, wherein a protective varnish is used, which comprises pigments and/or dyes and/or pigments that can be UV-activated and/or nanoparticles and/or upconverters and/or thermochromic dyes and/or photochromic dyes.

10. A process according to claim 7, wherein the protective varnish is removed again, at least regionally, after the treatment with the alkaline solution.

11. A process according to claim 6, wherein the mask layer is formed by full surface-area or partial application of a positive photoresist, light exposure of the partial region to be removed of the HRI layer, and removal of the light-exposed photoresist.

12. A process according to claim 6, wherein the mask layer is formed by full surface-area or partial application of a negative photoresist, light exposure of the partial region not to be removed of the HR1 layer, and removal of the photoresist not exposed to light.

13. A process according to claim 11, wherein a photoresist is used that contains dyes and/or pigments and/or pigments that can be UV-activated and/or nanoparticles and/or upconverters and/or thermochromic dyes and/or photochromic dyes.

14. A process according to claim 11, wherein the photoresist is removed, at least regionally, after the treatment with the alkaline solution.

15. A process according to claim 11, wherein the exposure to light is effected over the full surface area and/or over part of the surface area by means of a laser or a controllable mask.

16. A process according to claim 1, wherein the alkaline solution is printed on to the partial region to be removed of the HR1 layer.

17. A process according to claim 16, wherein the alkaline solution is printed on by flexographic printing or gravure printing.

18. A process according to claim 16, wherein an alkaline solution is used that contains at least one additive to increase the viscosity, and/or at least one wetting agent.

19. A process according to claim 18, wherein calcium carbonate, kaolin, titanium dioxide, Aerosil or silicon dioxide is used as an additive.

20. A process according to claim 1, wherein before the application of the HRI layer, at least one relief structure is molded at least in a partial region of the substrate.

21. A process for producing a multilayer body according to claim 1, in which, in at least one first region of a or the substrate, at least one first relief structure is molded into a first surface of the substrate, then an HRI layer or the HRI layer, which consists of a material having a high refractive index, is applied to at least part of the surface area of the first surface of the substrate, in such a manner that the HRI layer covers, at least regionally, the at least one first region and at least one second region of the substrate, in which the first relief structure has not been molded into the first surface of the substrate, and then a partial region of the HRI layer is physically removed from the substrate again by treatment with an alkaline solution, in such a manner that the HRI layer is removed in the partial region covering the at least one second region and remains on the substrate in the partial region covering the at least one first region.

22. A process according to claim 21, wherein the first relief structure is realized with a depth-to-width ratio of the individual structural elements of more than 0.15.

23. A process according to claim 21, wherein in the at least one second region no relief structure is molded into the substrate, or at least one second relief structure, which differs from the first relief structure, is molded into the substrate.

24. A process according to claim 23, wherein the first relief structure and the second relief structure are realized such that, owing to the relief structures, the adhesion of the layer to the substrate is greater in the at least one first region than in the at least one second region, wherein the spatial frequency of the first relief structure is greater than the spatial frequency of the second relief structure, the depth-to-width ratio of the structural elements of the first relief structure is greater than the depth-to-width ratio of the structural elements of the second relief structure, and/or the product of spatial frequency and the depth-to-width ratio of the structural elements of the first relief structure is greater than that of the second relief structure.

25. A process according to claim 21, wherein the at least one first relief structure and/or second relief structure is realized as a one-dimensional or two-dimensional diffractive grating structure having a spatial frequency of more than 1000 lines/mm.

26. A process according to claim 25, wherein the diffractive grating structure of the second relief structure is realized with a period of less than 3 μm.

27. A process according to claim 21, wherein the at least one first and/or second relief structure is realized as a light-diffracting and/or light-refracting and/or light-scattering and/or light-focusing microstructure or nanostructure, as an isotropic or anisotropic matte structure, as a binary or continuous Fresnel lens, as a micro-prism structure, as a blazed grating, as a macrostructure, or as a combination structure thereof.

28. A process according to claim 1, wherein before and/or after the application of the HRI layer, at least one further functional layer is applied.

29. A process according to claim 28, wherein the at least one further functional layer is realized as a varnish layer or a polymer layer.

30. A process according to claim 28, wherein the at least one further functional layer is realized with the addition of one or more multicolored, functional layer materials, and/or in that at least one partially shaped functional layer is realized as a hydrophobic or hydrophilic layer.

31. A process according to claim 28, wherein the at least one further functional layer is realized as an optically variable layer having an optical effect that differs depending on the viewing angle, and/or as a metallic reflection layer, and/or as a dielectric reflection layer.

32. A process according to claim 31, wherein the optically variable layer is realized in such a manner that it contains at least one substance having an optical effect that differs depending on the viewing angle, and/or is formed by at least one liquid-crystal layer having an optical effect that differs depending on the viewing angle, and/or by a thin-film layer stack having an interference color effect that is dependent on the viewing angle.

33. A process according to claim 1, wherein after the removal of the partial region of the HR1 layer, a further HRI layer is applied.

34. A process according to claim 1, wherein, after the removal of the partial region of the HRI layer, a further HR1 layer is applied, and then at least one partial region of the HRI layer is physically removed from the substrate again by treatment with an alkaline solution, wherein, the process is repeated one or more times.

35. A process according to claim 34, wherein the removed partial region of the HRI layer and the removed partial region of the further HRI layer do not overlap, or overlap only partially.

36. A process for producing a multilayer body comprising:

applying a High Refractive Index (HRI) layer which consists of a material having a high refractive index over an entire surface area of a substrate;

applying an alkaline solution on at least one partial region of the HRI layer such that the alkaline solution does not chemically dissolve the HRI layer in the at least one partial region, but, instead causes the HRI layer to physically flake off from the surface area of the substrate such that the HRI layer becomes detached as a whole in the at least one partial region to be removed; and completely removing the flaked off HRI layer as a whole in the at least one partial region.

37. A process for producing a multilayer body according to claim 36, in which a High Refractive Index (HRI) which consists of a material selected from the group: zinc sulfide; niobium pentoxide; and titanium oxide, is applied to at least part of the surface area of a substrate, and at least one partial region of the layer is then physically removed from the substrate again by treatment with an alkaline solution.

38. A process according to claim 37, wherein a pH value of the alkaline solution is at least 10.

39. A process according to claim 37, wherein the treatment with the alkaline solution is effected at a temperature of from 10° C. to 80° C.

* * * * *